US007985318B2

(12) United States Patent
Shevchenko et al.

(10) Patent No.: US 7,985,318 B2
(45) Date of Patent: Jul. 26, 2011

(54) METHOD OF MONITORING AND INHIBITING SCALE DEPOSITION IN PULP MILL EVAPORATORS AND CONCENTRATORS

(75) Inventors: Sergey M. Shevchenko, Aurora, IL (US); Prasad Y. Duggirala, Naperville, IL (US); Dmitri L. Kouznetsov, Aurora, IL (US)

(73) Assignee: Nalco Company, Naperville, IL (US)

( * ) Notice: Subject to any disclaimer, the term of this patent is extended or adjusted under 35 U.S.C. 154(b) by 484 days.

(21) Appl. No.: 11/746,947

(22) Filed: May 10, 2007

(65) Prior Publication Data

US 2008/0277083 A1 Nov. 13, 2008

(51) Int. Cl.
*D21C 7/14* (2006.01)

(52) U.S. Cl. ..... 162/48; 162/49; 162/29; 162/80; 422/13

(58) Field of Classification Search ..... 162/48, 162/49, 29, 36, 80; 422/13; 205/790.5
See application file for complete search history.

(56) References Cited

U.S. PATENT DOCUMENTS

| | | | | |
|---|---|---|---|---|
| 3,965,027 | A * | 6/1976 | Boffardi et al. | 252/180 |
| 4,018,702 | A * | 4/1977 | Boffardi et al. | 252/389.52 |
| 4,255,309 | A * | 3/1981 | Klaessig et al. | 524/517 |
| 4,263,092 | A * | 4/1981 | Klaessig et al. | 162/48 |
| 4,941,946 | A * | 7/1990 | Henn et al. | 162/36 |
| 5,254,286 | A * | 10/1993 | Gill et al. | 252/180 |
| 5,407,583 | A * | 4/1995 | Gill et al. | 210/701 |
| 5,409,571 | A * | 4/1995 | Togo et al. | 162/48 |
| 5,647,955 | A * | 7/1997 | Vaistomaa et al. | 162/30.11 |
| 5,716,496 | A * | 2/1998 | Agren | 159/49 |
| 6,090,240 | A * | 7/2000 | Eneberg et al. | 159/47.3 |
| 6,146,495 | A * | 11/2000 | Duggirala et al. | 162/48 |
| 6,235,152 | B1 * | 5/2001 | Duggirala et al. | 162/48 |
| 6,250,140 | B1 | 6/2001 | Kouznetsov et al. | |
| 6,333,005 | B1 * | 12/2001 | Nguyen | 422/13 |
| 6,355,214 | B1 * | 3/2002 | Fader et al. | 422/13 |
| 6,365,101 | B1 * | 4/2002 | Nguyen et al. | 422/13 |
| 6,440,327 | B1 * | 8/2002 | Shevchenko et al. | 252/175 |
| 6,632,419 | B2 * | 10/2003 | Rubsamen et al. | 424/43 |
| 6,645,428 | B1 * | 11/2003 | Morris et al. | 422/15 |
| 6,869,503 | B2 * | 3/2005 | Thompson et al. | 162/80 |
| 7,172,677 | B2 * | 2/2007 | Thompson et al. | 162/80 |
| 2001/0035271 | A1 * | 11/2001 | Duggirala et al. | 162/48 |
| 2002/0071783 | A1 * | 6/2002 | Fader et al. | 422/13 |
| 2002/0094299 | A1 * | 7/2002 | Nguyen et al. | 422/13 |
| 2002/0144950 | A1 * | 10/2002 | Shevchenko et al. | 210/698 |
| 2003/0010458 | A1 * | 1/2003 | Thompson et al. | 162/29 |
| 2003/0075290 | A1 * | 4/2003 | Thompson et al. | 162/29 |
| 2004/0256070 | A1 * | 12/2004 | Thompson et al. | 162/158 |
| 2005/0126727 | A1 * | 6/2005 | Thompson et al. | 162/29 |
| 2005/0244641 | A1 * | 11/2005 | Vincent | 428/403 |
| 2007/0062879 | A1 * | 3/2007 | Talbot et al. | 210/699 |
| 2007/0187300 | A1 | 8/2007 | Tran et al. | |

FOREIGN PATENT DOCUMENTS

EP 0517453 A1 9/1992

OTHER PUBLICATIONS

Smith & Hsieh, "Evaluation of sodium salt scaling in falling film black liquor evaporators," TAPPI Pulping/Process Product Quality Conference, 2000, pp. 10.
Smith & Hsieh, "Preliminary investigation into factors affecting second critical solids black liquor scaling," TAPPI Pulping/Process Product Quality Conference, 2000, pp. 1-9.
Smith et al., "Quantifying burkeite scaling in a pilot falling film evaporator," TAPPI Pulping Conference, 2001, pp. 898-916.

* cited by examiner

*Primary Examiner* — Mark Halpern
(74) *Attorney, Agent, or Firm* — Edward O. Yonter; Michael B. Martin

(57) ABSTRACT

A method of monitoring and inhibiting scale precipitation and deposition from spent liquor in pulp mill evaporators and concentrators is disclosed. The method includes connecting a black liquor deposition monitor to a pulp mill evaporator or concentrator and measuring the thermal conductivity on the outer surface of the monitor. A controller interprets the measured thermal conductivity and determines a level of scale deposition. If the level of scale deposition is above a predetermined level, the controller is operable to introduce a scale-inhibiting composition to the spent liquor. The scale-inhibiting composition may include organic polycarboxylic acids; organic fatty acids; low molecular weight and polymeric aromatic acids; organic acid esters, anhydrides, and amides; low molecular weight and polymeric aliphatic and aromatic sulfonic acids; and low molecular weight and polymeric amines; and any combinations.

15 Claims, No Drawings

METHOD OF MONITORING AND INHIBITING SCALE DEPOSITION IN PULP MILL EVAPORATORS AND CONCENTRATORS

TECHNICAL FIELD

This invention relates generally to methods of monitoring and inhibiting scale deposition. More specifically, the invention relates to a method of monitoring and inhibiting scale deposition from spent liquor in pulp mill evaporators and concentrators. The invention has particular relevance to a method of monitoring and inhibiting scale deposition in pulp mill evaporators and concentrators to improve process efficiency in pulping operations.

BACKGROUND

The kraft pulping process is one of the major pulping processes in the pulp and paper industry. Spent liquor resulting from the kraft pulping process (black liquor or "BL") contains various organic materials as well as inorganic salts, the deposition of which detracts from an efficient chemical recovery cycle. Inorganic pulping chemicals and energy are recovered by incinerating BL in a recovery boiler. For an efficient combustion in the recovery furnace, BL coming from the pulp digesters with relatively low solids concentration has to be evaporated and concentrated to at least 60% solids, typically in a multistage process (i.e., a multi-effect evaporator).

The alkaline pulping process differs from the kraft process in that no sodium sulfide is used in alkaline pulping, which results in less sodium sulfate in the spent liquor. In contrast, amounts of sodium, ammonium, magnesium, or calcium bisulfite are used in the sulfite process, resulting in high sulfate concentration in the spent liquor. The neutral sulfite semichemical ("NSSC") process combines sodium sulfite and sodium carbonate. While the ratio between the inorganic, scale-forming components is different for these processes, the components are essentially the same.

Inorganic salt scaling in spent liquor evaporators and concentrators continues to be one of the most persistent problems encountered in the pulp and paper industry. Concentrated liquor contains calcium, sodium, carbonate, and sulfate ions at levels high enough to form scales that precipitate from solution and deposit on heated surfaces. The most important types of scale in evaporators are hard scale, such as calcium carbonate ($CaCO_3$), and soft scale, such as burkeite ($2(Na_2SO_4):Na_2CO_3$). The solubility of both types of scale decreases as temperature increases, which causes the scales to adhere to heat transfer surfaces thus drastically reducing the overall efficiency of the evaporator (See Smith, J. B. & Hsieh, J. S., *Preliminary investigation into factors affecting second critical solids black liquor scaling. TAPPI Pulping/Process*, Prod. Qual. Conf., pp. 1 to 9, 2000 and Smith, J. B. & Hsieh, J. S., *Evaluation of sodium salt scaling in a pilot falling film evaporator. TAPPI Pulping/Process*, Prod. Qual. Conf., pp. 1013 to 1022, 2001; and Smith, J. B. et al., *Quantifying burkeite scaling in a pilot falling film evaporator*, TAPPI Pulping Conf., pp. 898 to 916, 2001).

Solubility of calcium carbonate in water is very low, whereas burkeite is soluble. Calcium carbonate deposits form extensively at many stages of the papermaking process. Control of calcium carbonate is a rather developed area outside evaporator applications. On the other hand, burkeite, which precipitates when total solids concentration reaches approximately 50%, represents a specific problem of evaporators and concentrators. While burkeite significantly affects productivity, neither monitoring methods nor chemical products exist for efficient burkeite control.

Affecting precipitation from a supersaturated solution of inorganic salts as water-soluble as burkeite is very difficult. (See U.S. Pat. Nos. 5,716,496; 5,647,955; 6,090,240). It is known though that sodium polyacrylate acts as a crystal-growth modifier for burkeite (See EP 0289312). Moreover, polyacrylic acids and methyl vinyl ether/maleic anhydride copolymers may act as inhibitors for soft scale, such as burkeite (See U.S. Pat. Nos. 4,255,309 and 4,263,092). Anionic/cationic polymer mixtures have also been suggested as scale control agents for evaporators. (See U.S. Pat. Nos. 5,254,286 and 5,407,583).

Generally, monitoring of inorganic scale is most efficiently achieved using quartz crystal microbalance ("QCM") based technologies. Applicability of QCM-based instruments is determined, however, by sensor crystal stability under process conditions. Such instruments cannot be used under high temperature and/or high alkalinity conditions. This limitation makes the technology useless in digesters and evaporators. Besides a simple gravimetric technique and a non-quantitative characterization using Lasentec-FBRM®, a laboratory technique based on deposit accumulation on the heated surface was proposed for liquors with solid content higher than 55%. No methods have been proposed for use in spent liquor evaporators or concentrators under normal operating conditions.

There thus exists an ongoing need to develop alternative and more efficient methods of monitoring and inhibiting burkeite and other scale deposition in the pulp and paper industry. Such inhibition is of particular importance in pulp mill evaporators and concentrators.

SUMMARY

This disclosure provides a method of inhibiting and/or monitoring scale deposition from spent liquor in a pulp mill evaporator or concentrator of a papermaking process. Types of scale normally include burkeite (soft scale), sodium sulfate and sodium carbonate (both of which are typically soft scale components), and the like, as well as entrapped organic material in some cases. In an embodiment, the scale also includes hard scale, such as calcium carbonate. The disclosed method has equal application in any type of pulp mill evaporator or concentrator, such as kraft, alkaline (i.e., soda), sulfite, and NSSC mill operations.

The method includes measuring thermal conductivity changes on a surface of a temperature-regulated sensor or probe. The thermal conductivity is dependent upon a level of scale deposit formation on the probe. In an embodiment the thermal conductivity is measured only on an outer surface of the probe. The reverse temperature-solubility dependence characteristic of scale deposits allows application of such a deposit monitoring technique. The thermal conductivity is inversely proportional to the mass of an accumulated deposit.

In an embodiment, the method includes inserting a probe having a temperature-regulated outer surface into the pulp mill evaporator/concentrator line. In an embodiment, the method also includes measuring the thermal conductivity of the temperature-regulated outer surface. The thermal conductivity is dependent upon an amount of scale deposition on the temperature-regulated outer surface. A level of scale deposition in the system is determined based upon the measured thermal conductivity. In one embodiment, the measured thermal conductivity is transmitted to a controller. According to an embodiment, if the determined level of scale deposition is above a predetermined level, an effective amount of a scale-inhibiting composition is added to the spent liquor.

In alternative embodiments, the invention includes adding one or more scale-inhibiting or deposit-controlling chemistries to the spent liquor. Representative chemistries include fatty acids of plant origin; organic fatty acids; aromatic acids, such as low molecular weight and polymeric aromatic acids; organic polycarboxylic acids; organic acid esters, anhydrides, and amides; low molecular weight and polymeric aliphatic and aromatic sulfonic acids; low molecular weight and polymeric amines; poly(acrylic/maleic) acid; the like; and any combinations. Strong unexpected synergism was observed with fatty acids of plant origin and poly(acrylic/maleic) acids used in combination. Other preferred chemistries include certain "green chemistries," such as liquid mixtures of solid fatty acids and their esters or fatty acids alone (typically derived from bioproducts including byproducts of biodiesel production).

In an aspect, the invention includes using a spent liquor monitor device for monitoring scale deposition. The device includes a probe having a temperature regulating mechanism or means and a mechanism or means to measure a thermal conductivity on the outer surface of the probe. The measured thermal conductivity on the outer surface is related to deposit formation on the outer surface. In an embodiment, the probe is operable to transmit the measured thermal conductivity to a controller. In an embodiment the device is thermo-sensitive and the thermal conductivity on the outer surface of the device increases with increased levels of deposit formation. It is contemplated that the device may also be used in a laboratory setting to test the efficacy of scale inhibitors.

Low solids content (such as below 55%) in dilute black liquor does not create a limitation for the use of the described device in the method of the invention. Scale problems begin to occur in spent liquor having solids content below 50%, so it is an important feature of the invention to not have such a limitation and to be efficient in black liquor having a wide range of solids content typically encountered in pulp mill evaporators and concentrators.

It is an advantage of the invention to provide a method of monitoring various types of scale deposition from spent liquor in pulp mill evaporators and concentrators.

An additional advantage of the invention is to provide a method of inhibiting soft scale deposition from spent liquor in pulp mill evaporators and concentrators.

A further advantage of the invention is to provide a method of inhibiting hard scale deposition from spent liquor in pulp mill evaporators and concentrators.

It is another advantage of the invention to prevent loss of production efficiency in pulp mill evaporators associated with boilouts caused by scale precipitation and deposition.

It is a further advantage of the invention to provide a method of continuous monitoring of the effects of process changes on scale deposition from spent liquor in pulp mill evaporators and concentrators.

Another advantage of the invention is to provide a method of continuous monitoring of scale control program performance in pulp mill evaporators and concentrators.

It is yet another advantage of the invention to provide a method of monitoring the concentration of a scale-inhibiting composition in spent liquor by using an inert fluorescent tracer.

Additional features and advantages are described herein and will be apparent from the following Detailed Description and Examples.

DETAILED DESCRIPTION

In an aspect, the method includes a device for monitoring soft scale in pulp mill evaporators and concentrators. Though any suitable device is contemplated, a preferred device is a spent or black liquor deposit monitor ("BLDM"). The BLDM includes a metal (e.g., stainless steel, alloy, or any other suitable material) probe or sensor equipped with a heater and heating controller, such as an electric, electronic, solid state, or any other heater and/or heating controller. The thermal conductivity on an outer surface of the device changes relative to scale deposition. The actual metal surface temperature can be monitored and controlled. In an embodiment, the BLDM includes an outer metal sheath and a skin thermocouple embedded underneath the outer metal sheath. In an embodiment, the temperature of the probe is controlled and regulated using components in the control panel. In a preferred embodiment, the BLDM is part of or in communication with a controller.

"Controller system," "controller," and similar terms refer to a manual operator or an electronic device having components such as a processor, memory device, cathode ray tube, liquid crystal display, plasma display, touch screen, or other monitor, and/or other components. In certain instances, the controller may be operable for integration with one or more application-specific integrated circuits, programs, or algorithms, one or more hard-wired devices, and/or one or more mechanical devices. Some or all of the controller system functions may be at a central location, such as a network server, for communication over a local area network, wide area network, wireless network, internet connection, microwave link, infrared link, and the like. In addition, other components such as a signal conditioner or system monitor may be included to facilitate signal-processing algorithms. In an embodiment, the controller is integrated with a control panel for the papermaking process.

In one embodiment, the control scheme is automated. In another embodiment, the control scheme is manual or semi-manual, where an operator interprets the measured thermal conductivity signals and determines any chemistry fed into the spent liquor line, such as scale-inhibiting composition dosage. In an embodiment, the measured thermal conductivity signal is interpreted by a controller system that controls an amount of scale-inhibiting composition to introduce to the system to keep the measured rate of thermal conductivity change within a predetermined range or under a predetermined value. In an embodiment, the controller interprets the signal and controls the amount of scale-inhibiting composition to introduce to the spent liquor line to maintain a rate of change of the measured thermal conductivity.

Deposition on the BLDM is typically caused by a temperature gradient between the spent liquor solution and the heated probe. The skin temperature is regulated using a controller that regulates the input wattage to the probe, resulting in a constant skin temperature profile under a fixed set of conditions in a non-scaling environment. Skin temperature increases due to deposit formation on the heat transfer surface are monitored. A scale layer creates an insulating barrier between the metal surface and the bulk water, preventing sufficient cooling, thereby causing a rise in the metal surface temperature. The probe's skin thermocouple is typically connected to a temperature controller/monitor that communicates with a data logger. In an embodiment, the probe includes a core thermocouple connected to the temperature controller/monitor.

In an embodiment, the thermal conductivity is measured and/or transmitted to a controller intermittently. In one embodiment, the thermal conductivity is measured and/or transmitted to a controller continuously. In another embodiment, the thermal conductivity is measured and/or transmitted according to a predetermined timescale. In yet another embodiment, the thermal conductivity is measured according to one timescale and transmitted according to another timescale. In alternative embodiments, the thermal conductivity may be measured and/or transmitted in any suitable fashion.

In one embodiment, the invention includes a method of inhibiting scale precipitation and deposition from spent liquor in a pulp mill evaporator or concentrator. "Spent liquor" refers to black liquor after a kraft, alkaline, sulfite, or neutral sulfite semichemical ("NSSC") mill operation. The scale may include burkeite, sodium sulfate, sodium carbonate, and entrapped organic material. Other scales may include calcium carbonate and/or organic material. It is contemplated that the method may be implemented to inhibit any type of scale in a variety of different systems.

Under conditions where the amount of scale is determined to warrant addition of a scale-inhibiting composition, the method includes introducing an effective amount of a scale-inhibiting composition to the spent liquor. The composition may include one or more compounds, such as organic mono- and polycarboxylic acids (e.g., fatty acids and low and high molecular weight aromatic acids); polymeric aromatic acids; organic acid esters, anhydrides, and amides; low and high molecular weight and polymeric aliphatic and aromatic sulfonic acids; low and high molecular weight and polymeric amines; and the like.

The acids may be used "as is" or in the form of precursors, which result in formation of acid functionalities when exposed to the process environment. Representative precursors include esters, salts, anhydrides, or amides. Combinations of these compounds may also be used and some combinations have a synergistic effect. For instance, a combination may include a maleic acid/acrylic acid copolymer mixed with fatty acids and/or fatty acid esters, as illustrated in the examples below.

In an embodiment, the fatty acids and/or fatty acid esters are derived from biodiesel manufacturing processes. Inexpensive byproducts may be generated at several stages during the manufacture of biodiesel, including the crude glycerin-processing phase. Such byproducts are also generated from transesterification reactions involving triglycerides. These byproducts are typically a mixture of fatty acids and fatty acid esters. For example, it may be a 1:1 ratio of fatty acids and fatty acid esters with a viscosity suitable for feeding into the spent liquor using standard equipment. According to an embodiment, the fatty acid byproduct may be derived from the addition of acid to the fatty acid salts solution of a crude fatty acid alkyl esters phase during the biodiesel manufacturing process. Alternatively, it may be derived from the addition of acid to the fatty acid salts solution of a crude glycerin phase. For example, the fatty acid byproduct may be derived by adding acid to the bottom effluent of the esterification stage and/or by adding acid to the wash water (e.g. soap water) of the ester product.

The fatty acid byproduct may also be derived from the acidulation of any of the biodiesel manufacturing process streams containing one or more fatty acid salt components. For example, addition of acid to the fatty acid salts solution of a crude fatty acid alkyl esters phase; addition of acid to the fatty acid salts solution of a crude glycerin phase; and acidulation of at least one biodiesel manufacturing process stream containing at least one fatty acid salts component.

In an embodiment, the fatty acid byproduct includes about 1 to about 50 weight percent of one or more methyl esters and about 50 to about 99 weight percent of one or more fatty acids. According to alternative embodiments, the fatty acid byproduct includes one or more methyl esters, organic salts, inorganic salts, methanol, glycerin, and water. Remaining components may include, for example, unsaponifiable matter.

It should be appreciated that the described derivation methods are exemplary and not intended to be limiting. For example, U.S. patent application Ser. No. 11/355,468, entitled "Fatty Acid Byproducts and Methods of Using Same (incorporated herein by reference in its entirety), provides a more thorough description of such biodiesel manufacturing process byproducts.

Representative free fatty acids derived from biodiesel byproducts include palmitic acid, palmitoleic acid, stearic acid, oleic acid, linoleic acid, linolenic acid, arachidic acid, eicosenoic acid, behenic acid, lignoceric acid, tetracosenic acid, the like, and combinations thereof. The fatty acid byproduct typically includes one or more of C6 to C24 saturated and unsaturated fatty acids, C6 to C24 saturated and unsaturated fatty acid salts, methyl esters, ethyl esters, the like, and combinations thereof. The fatty acid byproduct may further include one or more components, such as C1 to C6 mono-, di-, and tri-hydric alcohols, and combinations thereof.

In another embodiment, suitable fatty acids and alkyl esters are derived from tall oil stock, a wood processing byproduct. Typical tall oil fatty acid stock includes about 1% palmitic acid; about 2% stearic acid; about 48% oleic acid; about 35% linoleic acid; about 7% conjugated linoleic acid ($CH_3(CH_2)_X CH{=}CHCH{=}CH(CH_2)_YCOOH$, where x is generally 4 or 5, y is usually 7 or 8, and X+Y is 12); about 4% other acids, such as 5,9,12-octadecatrienoic acid, linolenic acid, 5,11,14-eicosatrenoic acid, cis,cis-5,9-octadecadienoic acid, eicosadienoic acid, elaidic acid, cis-11 octadecanoic acid, and C-20, C-22, C-24 saturated acids; and about 2% unsaponifiable matter.

In an embodiment, the scale-inhibiting composition includes an organic carboxylic acid, such as an acrylic-maleic acid copolymer in a ratio of 1:1 having a molecular weight from about 1,000 to about 50,000. In an embodiment, the composition includes an individual carboxylic acid or a mixture of fatty acids and/or fatty acid esters with a chain length from about 5 to about 50 and may originate from biodiesel byproducts, as explained above. In one embodiment, the composition includes an ethylene-vinyl acetate-methacrylic acid copolymer with a molecular weight from about 1,000 to about 50,000. In another embodiment, the composition includes phthalic acid and other aromatic vic-dicarboxylic acids. In yet another embodiment, the composition includes one or more linseed oil-derived polymers. Suitable linseed oil-derived polymers are prepared by heat polymerizing linseed oil in the presence of maleic anhydride with optional further pentaerythritol-mediated cross-linking.

In an embodiment, the scale-inhibiting composition includes an organic acid anhydride or amide. Representative anhydrides or amides include anhydrides of mono- or dicarboxylic acids, such as octadecenyl/hexadecenyl-succinic anhydride, octadecenyl/isooctadecenyl-succinic anhydride, fatty acid anhydrides blends, 1,8-naphthalenedicarboxylic acid amides, polyisobutenyl succinic anhydrides, the like, and their combinations. Suitable polyisobutenyl succinic anhydrides typically have a molecular weight range from about 400 Da to about 10 kDa.

In one embodiment, the scale-inhibiting composition includes sulfonic acids, such as a styrenesulfonic-maleic acid copolymer having a 1:1 ratio with a molecular weight from about 1,000 to about 50,000. In an embodiment, the sulfonic acid is a sulfonated naphthalene-formaldehyde condensate. In another embodiment, the sulfonic acid is an alkyl- or alkenyl-sulfonic acid having an alkyl chain length from about C5 to about C24.

In a further embodiment, the scale-inhibiting composition includes an amine, such as linear or cross-linked polyethyleneimine with molecular weight from about 1,000 to about 100,000. In an embodiment, the amine is a carboxymethyl or dithiocarbamate derivative of linear or cross-linked polyethyleneimine with molecular weight from about 1,000 to about 100,000. In one embodiment, the amine is an N-vinylpyrrolidone-diallyldimethylammonium copolymer. In another embodiment, the amine is a 4-piperidinol, such as 2,2,6,6-tetramethyl-4-piperidinol, or any other aliphatic or cyclic amine.

Not to be bound to any particular theory, it is theorized that esters, anhydrides, and amides of certain organic acids demonstrate activity due to their fast hydrolysis and release of free acids. Further, activities of described sulfonic acids and amines were unexpected. Their mechanism of action is likely different from those of carboxylic acids, therefore, they may be used as components of synergistic compositions or as a stand-alone composition. For example, the combination of acrylic acid-maleic acid copolymer and fatty acids/esters is likely due to the different mechanisms of polycarboxylates (blocked crystal growth) and long-chain fatty acids/esters (increased agglomeration in solution volume decreases likelihood of particles depositing on surfaces). It should be appreciated that all possible combinations of the described types of chemistries may be used.

In alternative embodiments, the temperature within the pulp mill evaporator or concentrator may range widely. For example, in certain applications the temperature of the spent liquor may be from about 90° C. to about 120° C., where the temperature gradient between the spent liquor and the heated probe is from about 70° C. to about 80° C. Temperatures from about 170° C. to about 190° are preferred for the probe, though a more preferred range is from about 180° C. to about 185° C. Typical flow rates in a pulp mill evaporator or concentrator are from about 0.5 to about 3 gal/min. The temperature gradient is affected by the flow rate and the spent liquor temperature and is typically adjusted for each application. The flow and composition of the spent liquor affects the mass and heat transfer to/from the heated surface of the probe. Thus, the time of deposition (i.e., deposit accumulation) and the target temperature gradient are accordingly adjusted. These parameters are specific to particular evaporator conditions and should be determined empirically or theoretically for each application. Maintaining a constant flow rate is generally accomplished with an automatic flow regulator, such as a backpressure regulator.

A preferred range of scale-inhibiting composition for treating the spent liquor is from about 1 to about 2,000 parts per million, based on spent liquor. A more preferred dosage is from about 20 ppm to about 1,000 ppm. Most preferably, the dosage range is from about 50 ppm to about 500 ppm, based on spent liquor.

In alternative embodiments, monitoring the composition dosage and concentration in the system includes using molecules having fluorescent or absorbent moieties (i.e., tracers). Such tracers are typically inert and added to the system in a known proportion to the scale-inhibiting composition. "Inert" as used herein means that an inert tracer (e.g., an inert fluorescent tracer) is not appreciably or significantly affected by any other chemistry in the spent liquor, or by other system parameters, such as temperature, pressure, alkalinity, solids concentration, and/or other parameters. "Not appreciably or significantly affected" means that an inert fluorescent compound has no more than about 10 percent change in its fluorescent signal, under conditions normally encountered in spent liquor.

Representative inert fluorescent tracers suitable for use in the method of the invention include 1,3,6,8-pyrenetetrasulfonic acid, tetrasodium salt (CAS Registry No. 59572-10-0); monosulfonated anthracenes and salts thereof, including, but not limited to 2-anthracenesulfonic acid sodium salt (CAS Registry No. 16106-40-4); disulfonated anthracenes and salts thereof (See U.S. Pat. App. No. 2005/0025659 A1, and U.S. Pat. No. 6,966,213 B2, each incorporated herein by reference in its entirety); other suitable fluorescent compounds; and combinations thereof. These inert fluorescent tracers are either commercially available under the trade name TRASAR® from Nalco Company® (Naperville, Ill.) or may be synthesized using techniques known to persons of ordinary skill in the art of organic chemistry.

Monitoring the concentration of the tracers using light absorbance or fluorescence allows for precise control of the scale-inhibiting composition dosage. For example, the fluorescent signal of the inert fluorescent chemical may be used to determine the concentration of the scale-inhibiting composition or compound in the system. The fluorescent signal of the inert fluorescent chemical is then used to determine whether the desired amount of the scale-inhibiting composition or product is present in the spent liquor and the feed of the composition can then be adjusted to ensure that the desired amount of scale-inhibitor is in the spent liquor. Such combination with fluorescence-based concentration monitoring ensures comprehensive system characterization.

EXAMPLES

The foregoing may be better understood by reference to the following examples, which are intended for illustrative purposes and are not intended to limit the scope of the invention.

Express Testing Protocol

Black liquor saturated with synthetic burkeite was prepared by dissolving premixed 1:2.68 (weight-to-weight ratio) anhydrous sodium carbonate/sodium sulfate for 3 hours in approximately 40% black liquor (diluted from 50% black liquor to reduce viscosity). 1.5 kg of the anhydrous solid mixture was used per 5-liter sample. The solution was reused, after resaturation with solid synthetic burkeite. The burkeite-saturated synthetic black liquor was kept until all solids settled out of solution, and then decanted.

Express testing for burkeite precipitation and deposition included placing a 600 ml sample of the synthetic burkeite-saturated black liquor in a stainless steel cylinder equipped with a thermocouple and a heating element. The heating element was a stainless steel 100-watt heating rod. The rod was heated at full strength for 20 min to allow the sample to reach a final temperature of about 95° C., removed from the cylinder, and then air-cooled. Burkeite deposits on the rod were mechanically removed from the surface of the rod, dried at 105° C., and weighed. The percent inhibition ("% I") was gravimetrically determined and each sample was normalized against a control according to the following formula: % I=100×([Control]−[Sample])/[Control]).

Black Liquor Deposit Monitor ("BLDM") Testing Protocol

A black liquor circulation system with a 6-liter digester (available from M/K Systems, Inc. in Bethesda, Md.) was setup and connected to a BLDM. The main component of the BLDM device was a heated mild steel ⅜×6 inch probe capable of heat fluxes up to 138 kBtu/hr-ft$^2$ (Watt density 254

W/in$^2$). A skin thermocouple was embedded underneath an outer metal sheath, centered along the heat transfer length. The actual metal surface temperature was monitored and the power of the heated probe was controlled and regulated using the rig's control panel.

The skin thermocouple was connected to a temperature controller that was hooked to a MadgeTech datalogger (available from MadgeTech, Inc. in Warner, N.H.). The core thermocouple was connected to the temperature controller. The solution was pre-heated, and the probe itself maintained the temperature. Two thermocouples monitor the probe's inlet and outlet water to ensure that the flow is fast enough to provide non-boiling conditions.

Deposition on the BLDM probe was induced by a temperature gradient between the solution and the probe, where the skin temperature was controlled using a Eurotherm 2200 Series controller that regulated the input wattage to the probe. The skin temperature remained constant under a fixed set of conditions in a non-scaling environment. Under deposit formation conditions, the unit displayed increasing skin temperature due to the thermal insulating effect of the deposit, which prevented heat exchange between the metal surface and the bulk solution.

Test solutions were synthetic burkeite-saturated black liquor, as described above. The solution can be reused after resaturation with 500 grams of solid synthetic burkeite. Different inhibitors, as indicated in the tables below, were added to each test solution at the end of the saturation process and mixed well. Flow was maintained between 0.75 and 1.0 gpm. An immersion heater was placed in the digester so that the heating element was fully immersed and did not touch the walls. The solution was preheated from about 43° C. to 45° C., at which time the heater was removed and lid closed. The power was applied at 17%, and data was collected in 1-minute intervals.

In calcium carbonate tests, the test solutions were pulp mill black liquors (about 25% solids). Different inhibitors were added to each test solution and mixed well while maintaining a flow of 0.5 gpm. The solution was preheated to 101° C. (closed lid). The power was applied so that the skin temperature initially reached 170° C. A 0.1% (based on $Ca^{2+}$ ions) calcium chloride solution was dosed for 90 minutes at a rate of 1 ml/min. Data was collected in 1-minute intervals.

Selected chemistries were tested using BLDM under laboratory conditions. The results are generally consistent with the express testing protocol, but more realistically represent the scaling process in evaporators. Therefore, while both tests allow identifying active chemistries, the BLDM test is more suitable for fine differentiation. This test revealed synergism between the AM and fatty acids. Optimal results were achieved with about a 1:1 AM/fatty acid composition. These chemicals are not mixable, and a single product is not possible to formulate. However, when fed separately, they easily dissolve (AM) or disperse (fatty acid/fatty acid ester composition) in hot black liquor. In separate experiments, it was shown that the chosen chemistries inhibited not only burkeite deposition, but also its individual components, sodium carbonate and sodium sulfate.

In a field test, the BLDM was installed after the 1st effect pump (approx. 50% solids—the deposit sample from the same site was earlier identified as burkeite based on analytical data). The instrument was connected to the system in a side-stream arrangement using a 50-ft. curved hose past the feeding system that provided sufficient mixing and residence time. The liquor had been returned the second effect evaporator line. Two products targeted for testing, FA/FAME and AM, are not mixable though they easily disperse in the black liquor; therefore, two separate feeding systems were installed.

The conditions for induced burkeite deposition on the BLDM sensor from the effect evaporator black liquor were found, and a reproducible baseline recorded. Accumulation occurred slowly, with a significant induction period. Applying excessive power to accelerate fouling or deposition is not recommended because, after an induction period, the probe temperature increases exponentially. Also, thermolysis of the organic material on the heated surface should be avoided, so minimal heat application is typically the best practice. The optimal initial temperature for this test was found to be about 183° C. The deposition rate and pattern depends on the nature of the liquor, but slow in the beginning, gradually increasing temperature response of the probe is typical.

It should be emphasized that, because of the nature of the monitoring technique (temperature-induced deposition), the "exponential" response of the instrument in the end of the experiments does not mean exponential growth of the deposit—it just indicates passing a certain threshold. A standard test lasts for about a day. Milder conditions would provide better differentiation but take more time. Post-testing, the deposit was collected from the surface of the probe and analyzed. According to the analysis, the deposit was 70% burkeite. Inhibition of burkeite scale by two of the compounds tested above (FA/FAME and AM) and their mixture was observed. Both compounds showed good performance, and their mixture appeared to have a synergistic effect (Examples 8 and 9).

Examples 1 to 6 show results of the selected chemistries on burkeite scale using the express testing protocol.

Example 1

Table 1 below lists results for express testing of carboxylic acid compounds. AM is a 40% acrylic/maleic co-polymer 50150, MW 4K to 10K. C-810L fatty acid blend is available from P&G Chemicals, in Cincinnati, Ohio. FA/FAME is a commercial biodiesel byproduct mixture of C6 to C18 fatty acids/fatty acid methyl esters in a 60:40 ratio (available from Purada Processing, LLC. in Lakeland, Fla.). Oxicure 300 is a fatty acid ester product available from Cargill, Inc, in Minneapolis, Minn. The EVA-MA copolymer is poly(ethylene-co-vinyl acetate-co-methacrylic acid), 25% vinyl acetate. LOP is a 100% linseed oil polymer prepared by heat polymerizing linseed oil in the presence of maleic anhydride with further cross-linking using pentaerythritol.

TABLE 1

| Additive | Dose, ppm | % I |
|---|---|---|
| AM | 500 | 54 |
| C-810L Fatty Acid | 1000 | 50 |
| FA/FAME | 1000 | 71 |
| FA/FAME | 500 | 30 |
| Oxicure 300 | 1000 | 73 |
| Oxicure 300 | 500 | 25 |
| Polyacrylate (MW > 1M, emulsion) | 1000 | 20 |
| Phthalic acid | 1000 | 30 |
| "Ester bottoms" (fatty acids, high MW) | 1000 | 36 |
| EVA-MA copolymer | 1000 | 49 |
| LOP | 1000 | 43 |
| LOP | 500 | 14 |

Example 2

Table 2 below shows results for express testing of scale-inhibiting compositions including organic acid anhydrides and amides. OHS and OIS are 25% octadecenyl/71% hexadecenyl-succinic anhydride and 47% octadecenyl/47% isooctadecenyl-succinic anhydride, respectively. NDH is 1,8-naphthalenedicarboxylic acid 2-dimethylaminoethyleneamide hydrochloride.

TABLE 2

| Additive | Dose, ppm | % I |
|---|---|---|
| OHS | 1000 | 60 |
| OIS | 1000 | 54 |
| Fatty Acid Anhydrides | 1000 | 59 |
| NDH | 1000 | 31 |

Example 3

Table 3 below lists results for sulfonic acid scale-inhibiting additives using the express testing protocol. The approximate molecular weight of the poly(styrenesulfonic acid-co-maleic acid 1:1), sodium salt was about 20 kD. Dehsofix-920 is naphthalenesulfonate-formaldehyde condensate, sodium salt (available from Tenneco Espana, SA). Lomar D is sulfonated naphthalene condensate, sodium salt (available from Cognis Corp. in Cincinnati, Ohio).

TABLE 3

| Additive | Dose, ppm | % I |
|---|---|---|
| Poly(styrenesulfonic acid-co-maleic acid), sodium salt | 1000 | 37 |
| Dehsofix-920 | 1000 | 50 |
| Lomar D | 1000 | 51 |
| 1-Octanesulfonic acid | 1000 | 20 |

Example 4

Table 4 below shows express testing protocol results for scale inhibitors having polymeric amines. Polymin® P is a 50% cross-linked polyethyleneimine having a molecular weight of approximately 70 kD (available from BASF® Corporation in Florham Park, N.J.). PEI-1 is a lower molecular weight polyethyleneimine with 35% EDC-ammonia. PEI-2 is a higher MW polyethyleneimine with 35% EDC-ammonia. PEI-3 represents a 23% solution of 60% carboxymethylated PEI-1 and PEI-4 represents a 23% solution of carboxymethylated PEI-2. PDC is a polyethyleneimine dithiocarbamate. Poly (DADMAC-co-NVP) is a 25% N-vinylpyrrolidone-diallyldimethylammonium chloride/10% DADMAC copolymer.

TABLE 4

| Additive | Dose, ppm | % I |
|---|---|---|
| Polymin ® P | 1000 | 37 |
| 2,2,6,6-Tetramethyl-4-piperidinol | 1000 | 38 |
| PEI-1 | 1000 | 47 |
| PEI-2 | 1000 | 33 |
| PEI-3 | 1000 | 43 |
| PEI-4 | 1000 | 36 |
| PDC | 1000 | 41 |
| Poly (DADMAC-co-NVP) | 1000 | 28 |

Example 5

Table 5 below list results from express protocol testing of various mixtures of scale-inhibiting additives. AM and FA/FAME are as defined above. SX is 40% sodium xylenesulfonate. PP is a viscosity modifier including 25% oxidized ethene homopolymer (polyalkylene-polycarboxylate), potassium salt; 9% ethoxylated nonylphenol; and 1% propylene glycol. TTP is 6% triethanolamine tri(phosphate ester), sodium salt; 9% acrylic acid—methyl acrylate copolymer, sodium salt; 3% ethoxylated tert-octylphenol phosphate; and 3% ethylene glycol—propylene glycol copolymer.

TABLE 5

| Additive | Dose, ppm | % I |
|---|---|---|
| SX & AM | 500 each | 54 |
| SX & AM | 250 each | 31 |
| PP & AM | 500 each | 18 |
| TTP & AM | 500 each | 27 |
| FA/FAME & AM | 250 each | 39 |

Example 6

Table 6 below shows the ability of various fatty acids and mixtures of fatty acids with fatty acid esters to inhibit scale formation using the express testing protocol described above. Properties and compositions of fatty acid mixtures produced from agricultural raw materials can vary significantly, including seasonal variations and changes expected when a new supplier is introduced. A series of individual fatty acids were examined, and, in a separate experiment, compared to fatty acid/methyl ester compositions from different suppliers. The data indicated that compositional variations will unlikely significantly affect performance, and optimal composition is typically about a 1:1 ratio of fatty acids and fatty acids methyl esters. This product is a liquid that provides good performance and may also be used in combination with a polycarboxylate (high molecular weight fatty acids are typically solid or highly viscous). The results indicate that variations in the composition of fatty acid/fatty acid ester mixtures originating from different agricultural sources will unlikely affect performance.

TOFA 1 and TOFA 2 were light-colored tall oil fatty acid produced via fractional distillation of crude tall oil (available under the trade names XTOL® 101 and XTOL® 300, respectively, from Georgia-Pacific Chemicals in Atlanta, Ga.).

TABLE 6

| Chemical | Dose, ppm | % I |
|---|---|---|
| Experiment 1 | | |
| Hexanoic Acid | 1000 | 66 |
| Myristic Acid | 1000 | 22 |
| Dodecanoic Acid | 1000 | 74 |
| Stearic Acid | 1000 | 60 |
| Nonanoic Acid | 1000 | 47 |
| TOFA 1 | 500 | 95 |
| Undecanoic Acid | 1000 | 57 |
| FA/FAME | 500 | 58 |
| Heptadeconoic Acid | 1000 | 49 |
| Palmitic Acid | 1000 | 46 |
| TOFA 1 | 500 | 60 |
| Experiment 2 | | |
| TOFA 1 | 500 | 22 |
| TOFA 1 | 1000 | 57 |
| TOFA 2 | 500 | 40 |
| TOFA 2 | 1000 | 55 |
| FA/FAME | 500 | 73 |
| FA/FAME | 1000 | 72 |
| Experiment 3 | Softwood | |

TABLE 6-continued

| Chemical | Dose, ppm | % I |
|---|---|---|
| FA/FAME | 1000 | 92 |
| AM | 1000 | 91 |
| FA/FAME | 1000 | 95 |
| AM | 1000 | 95 |
| Experiment 4 | Hardwood | |
| AM | 1000 | 61 |
| AM | 1000 | 78 |
| FA/FAME | 1000 | 90 |

Example 7

This Example illustrates performance of selected chemistries on calcium carbonate scale using the BLDM. Table 7 illustrates results from a calcium carbonate scale inhibition laboratory experiment with a comparative parameter (% fouling or "% F") characterizing thermal conductivity. PP23-3389 and Scale-Guard® 60119 are commercial calcium carbonate scale inhibitors (available from Nalco Company® in Naperville, Ill.). Evaporator black liquor from a Midwest mill derived from standard maple kraft was used in the experiments.

TABLE 7

| Time (min) | Baseline % F | 600 ppm PP23-3389 | 600 ppm 1:1 Scale-Guard ® 60116 | 350 ppm 1:1 Scale-Guard ® 60116 |
|---|---|---|---|---|
| 75 | 19.9 | 0 | 0.2 | 0 |
| 100 | 53 | 2.8 | 1.8 | 2.9 |
| 150 | 112.4 | 7.6 | 5.5 | 7.5 |
| 200 | 153.8 | 12.7 | 2.8 | 9.7 |
| 250 | 172.9 | 17.3 | 5.4 | 11.6 |
| 300 | 181.2 | 21.7 | 6.5 | 13.8 |
| 400 | — | 28.3 | 7.9 | 15.4 |
| 500 | — | — | 8.9 | 17.6 |
| 1,000 | — | — | 9.2 | 23.9 |

Example 8

Laboratory-testing results of selected chemistries on burkeite scale using the BLDM are illustrated. Shown in Table 8 are results from burkeite scale inhibition in the laboratory experiments. The black liquor source was a Southern mill evaporator.

TABLE 8

| Time (min) | Baseline % F | 1,000 ppm FA/FAME | Baseline % F | 1,000 ppm AM | Baseline % F | 1,000 ppm 2:1 AM-FA/FAME |
|---|---|---|---|---|---|---|
| 30 | 272 | 193 | 109 | 65 | 123 | 43 |
| 60 | 432 | 277 | 154 | 110 | N/A | 75 |
| 120 | N/A | N/A | 235 | 153 | N/A | 105 |

Example 9

In this Example, selected chemistries were tested in a mill setting using the BLDM and with sidestream arrangement. Table 9 shows the effect of scale inhibitors on burkeite deposition from field-testing is illustrated. Southern mill black liquor was used under mill conditions—hardwood, sidestream arrangement, with chemicals fed into the sidestream line.

TABLE 9

| Time (min) | Baseline % F | 1,000 ppm AM | 1,000 ppm FA/FAME | 1,000 ppm 1:1 AM-FA/FAME |
|---|---|---|---|---|
| 300 | 21 | 5 | 10 | 1 |
| 500 | 33 | 8 | 15 | 4 |
| 600 | 65* | 9 | 20 | 5 |
| 800 | — | 13 | 30 | 8 |
| 1,000 | — | 21 | — | 15 |
| 1,100 | — | 25 | — | 20 |
| 1,200 | — | 88* | — | 20 |
| 1,500 | — | — | — | 25 |
| 1,700 | — | — | — | 166* |

*indicates exponential growth

It should be understood that various changes and modifications to the embodiments described herein would be apparent to those skilled in the art. Such changes and modifications can be made without departing from the spirit and scope of the invention and without diminishing its intended advantages. It is therefore intended that such changes and modifications be covered by the appended claims.

The claimed invention is:

1. A method of inhibiting scale deposition from a black liquor in a pulp mill evaporator or concentrator, the method comprising:

(a) determining a level of scale deposition in the pulp mill evaporator or concentrator; and (b) adding an effective amount of a scale-inhibiting composition to the black liquor, if the determined level of scale deposition is above a predetermined level;

(c) wherein the scale-inhibiting composition includes (i) one or more fatty acids of plant origin and (ii) one or more compounds selected from the group consisting of: polyacrylic acids; polymaleic acids; and any combination thereof.

2. The method of claim 1, further comprising:

(a) inserting a probe having a temperature-regulated outer surface into the pulp mill evaporator or concentrator;

(b) contacting the temperature-regulated outer surface with the spent liquor;

(c) measuring a thermal conductivity of the temperature-regulated outer surface, wherein the thermal conductivity is dependent upon an amount of scale deposition on the temperature-regulated outer surface;

(d) transmitting the measured thermal conductivity to a controller;

(e) determining a level of scale deposition in the pulp mill evaporator or concentrator, based upon the measured thermal conductivity; and (f) adding an effective amount of the scale-inhibiting composition to the spent liquor, if the determined level of scale deposition is above the predetermined level.

3. The method of claim 2, including intermittently measuring the thermal conductivity on the temperature-regulated outer surface of the probe.

4. The method of claim 2, including continuously measuring the thermal conductivity on the temperature-regulated outer surface of the probe.

5. The method of claim 1, wherein the black liquor has a solids content below about 50%.

6. The method of claim 1, wherein the black liquor is derived from a process selected from the group consisting of kraft, alkaline, sulfite, and neutral sulfite semichemical.

7. The method of claim 1, wherein the scale includes one or more scales selected from the group consisting of: burkeite, sodium sulfate, sodium carbonate, entrapped organic material, calcium carbonate, and combinations thereof.

8. The method of claim 1, including adding about 1 ppm to about 2,000 ppm of the scale-inhibiting composition, based on volume of the black liquor.

9. The method of claim 1, wherein the one or more fatty acids of plant origin is a linseed oil heat polymerized in the presence of maleic anhydride and optionally cross-linked with pentaerythritol.

10. The method of claim 1, wherein the one or more fatty acids of plant origin include one or a mixture of fatty acids and/or fatty acid esters with chain length from about C5 to about C50.

11. The method of claim 1, wherein one or more of the one or more fatty acids of plant origin is derived from a biodiesel manufacturing process.

12. The method of claim 1, wherein the one or more fatty acids of plant origin is derived from one or more phases of a biodiesel manufacturing process selected from the group consisting of addition of acid to the fatty acid salts solution of a crude fatty acid alkyl esters phase; addition of acid to the fatty acid salts solution of a crude glycerin phase; acidulation of at least one biodiesel manufacturing process stream containing at least one fatty acid salts component; transesterification reactions involving triglycerides; and any combinations thereof.

13. The method of claim 1, wherein the one or more fatty acids of plant origin is selected from the group consisting of: palmitic acid, palmitoleic acid, stearic acid, oleic acid, linoleic acid, linolenic acid, arachidic acid, eicosenoic acid, behenic acid, lignoceric acid, tetracosenic acid, and any combinations thereof.

14. The method of claim 1, wherein the pulp mill evaporator is a multiple-effect evaporator.

15. The method of claim 1, including monitoring the concentration of the scale-inhibiting composition in the spent liquor by using an inert fluorescent tracer.

* * * * *